US006994183B2

(12) United States Patent
Peters

(10) Patent No.: US 6,994,183 B2
(45) Date of Patent: Feb. 7, 2006

(54) FIRE ESCAPE LADDER

(76) Inventor: Dennis Peters, 3740 Oak Valley, Wyoming, MI (US) 49509

( * ) Notice: Subject to any disclaimer, the term of this patent is extended or adjusted under 35 U.S.C. 154(b) by 8 days.

(21) Appl. No.: 10/735,126

(22) Filed: Dec. 12, 2003

(65) Prior Publication Data

US 2004/0178017 A1 Sep. 16, 2004

Related U.S. Application Data

(60) Provisional application No. 60/432,770, filed on Dec. 12, 2002.

(51) Int. Cl.
*A62B 1/06* (2006.01)

(52) U.S. Cl. ..... 182/76; 182/70

(58) Field of Classification Search ..... 182/76, 182/70, 74, 73, 196, 192
See application file for complete search history.

(56) References Cited

U.S. PATENT DOCUMENTS 433,061 A * 7/1890 Aarons ..... 182/76
3,344,886 A * 10/1967 Boscarino, Jr. ..... 182/70
4,079,811 A * 3/1978 Driskell ..... 182/35
4,127,184 A * 11/1978 Strohmeyer ..... 182/70
4,445,589 A * 5/1984 Longenecker ..... 182/76
5,467,841 A * 11/1995 Krumal ..... 182/70
5,628,380 A * 5/1997 Matisi ..... 182/70
5,971,105 A * 10/1999 Jacobson ..... 182/198
6,129,178 A * 10/2000 Shupp, Jr. ..... 182/76
6,135,239 A * 10/2000 Martin et al. ..... 182/70

FOREIGN PATENT DOCUMENTS

GB 2156888 A * 10/1985

* cited by examiner

*Primary Examiner*—Hugh B. Thompson, II
(74) *Attorney, Agent, or Firm*—Varnum, Riddering, Schmidt & Howlett LLP

(57) ABSTRACT

A fire escape ladder assembly adapted for mounting between wall support members in a building cavity of a building structure. The assembly includes a fire escape ladder enclosure mounted in the building cavity and a mounting structure passing through the enclosure and surrounding building support members to anchor the fire escape ladder directly to the building structure. The enclosure can include a portion for mounting within a wall cavity and can further include a portion for mounting within a building floor cavity. The mounting structure can include a threaded rod passing through apertures in adjacent wall studs and maintained in a centered position by lock nuts.

16 Claims, 7 Drawing Sheets

FIRE ESCAPE LADDER

CROSS-REFERENCES TO RELATED APPLICATIONS

This is a non-provisional application based on and claiming the filing priority of co-pending provisional patent application Ser. No. 60/432,770, filed Dec. 12, 2002.

BACKGROUND OF THE INVENTION

This invention relates to a flexible, stowable fire escape ladder adapted for storage in a box or in the wall structure of a building.

Currently, affixed fire escape ladders are well-known in multi-story, multi-unit structures. These structures can be commercial or residential in nature.

Less common are single unit residential structures with fixed fire escape ladders. In such instances, it has been known to provide portable or removable ladders, either rigid or flexible in nature. Examples of such ladders are found in U.S. Pat. No. 1,196,419 to Banyovits, U.S. Pat. No. 3,329,328 to Guldie, U.S. Pat. No. 3,809,181 to Steranic, et al., U.S. Pat. No. 6,012,549 to Adams, U.S. Pat. No. 5,971,105 to Jacobson, U.S. Pat. No. 6,029,771 to Keown, U.S. Pat. No. 6,129,178 to Shupp, Jr., U.S. Pat. No. 6,135,239 to Martin, et al., and U.S. Pat. No. 4,445,589 to Longenecker. Some of these removable, flexible fire escape ladders comprise storage compartments affixed to an interior wall such as adjacent to or beneath a window. Some references include compartments stored within a wall cavity and opening to the inside of the room adjacent the window and some comprise storage compartments opening on an outside wall adjacent a wall opening such as a window.

For permanently installed stowable ladders, it is required that there be sufficient space underneath a window to stow the bulk of the ladder. In instances where the lower sill of the window is close to the floor, such a stowable ladder cannot be used or must be stowed on the exterior wall of the structure, such as in the Longenecker '589 reference. In either case, the compartment storing the ladder is secured to a portion of the building structure, such as with screws, while the ladder is attached to the storage compartment itself.

An object of the present invention is to provide a stowable ladder that is secured to the building structure itself to provide a stronger anchoring point for the ladder. Another object is to provide a stowable fire escape ladder that can be stowed inside a building structure even in those installations where the windowsill is otherwise too close to the floor to afford room for a fire escape ladder stowage compartment in the wall.

SUMMARY OF THE INVENTION

A ladder that is collapsible for storage in a cavity embedded within a wall of a building structure, and extendible from the cavity for release through an exterior opening of the building structure for egress during an emergency, comprises a first end for attachment to the building structure, a second end for release through the exterior opening, and a plurality of interconnected steps and links joining the first and second ends. The ladder further comprises an attachment structure for passing through an aperture in a structural member of the building structure and for connecting the first end of the ladder to the building structure.

In a further embodiment, the attachment structure is a rod inserted through a pair of corresponding apertures in adjacent structural wall members of the building structure.

In a further embodiment, the rod is threaded and held in alignment with the adjacent structural wall members by a plurality of threaded fasteners.

In a further embodiment, the ladder is collapsible for storage in a cavity embedded within a floor of a building structure and extendible from the cavity for release through an exterior opening of the building structure for egress during an emergency.

These and other features, objects, and benefits of the invention will be recognized by one having ordinary skill in the art and by those who practice the invention, from the specification, the claims, and the drawing figures.

DETAILED DESCRIPTION OF THE PREFERRED EMBODIMENT

Figure 1:
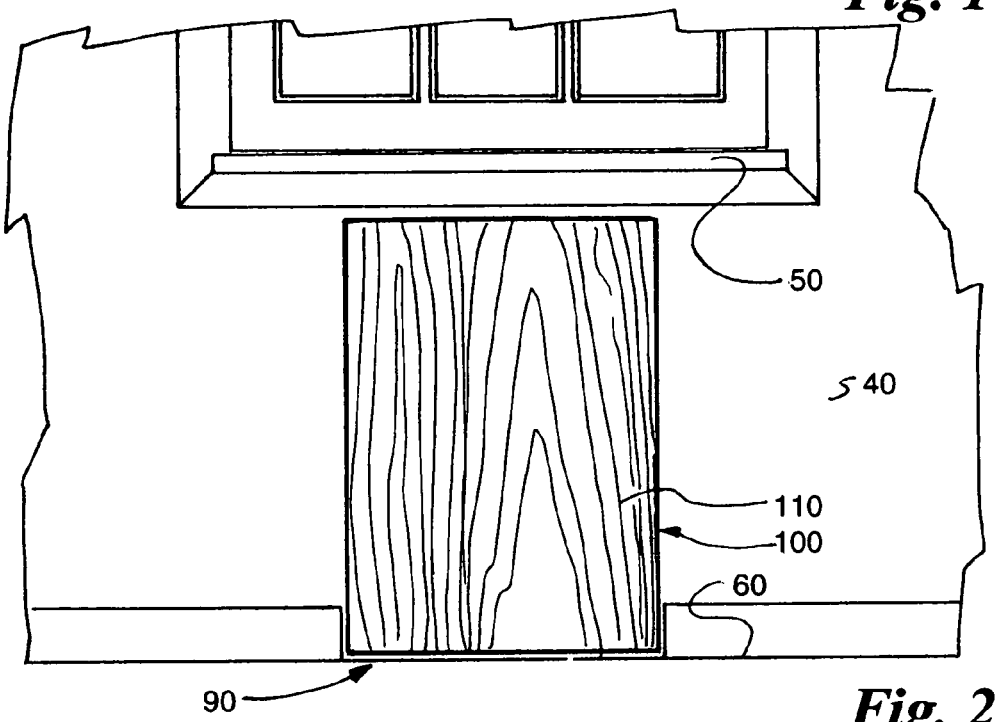
FIG. 1 is a front view of a fire escape ladder enclosure according to the invention.
Figure 2:
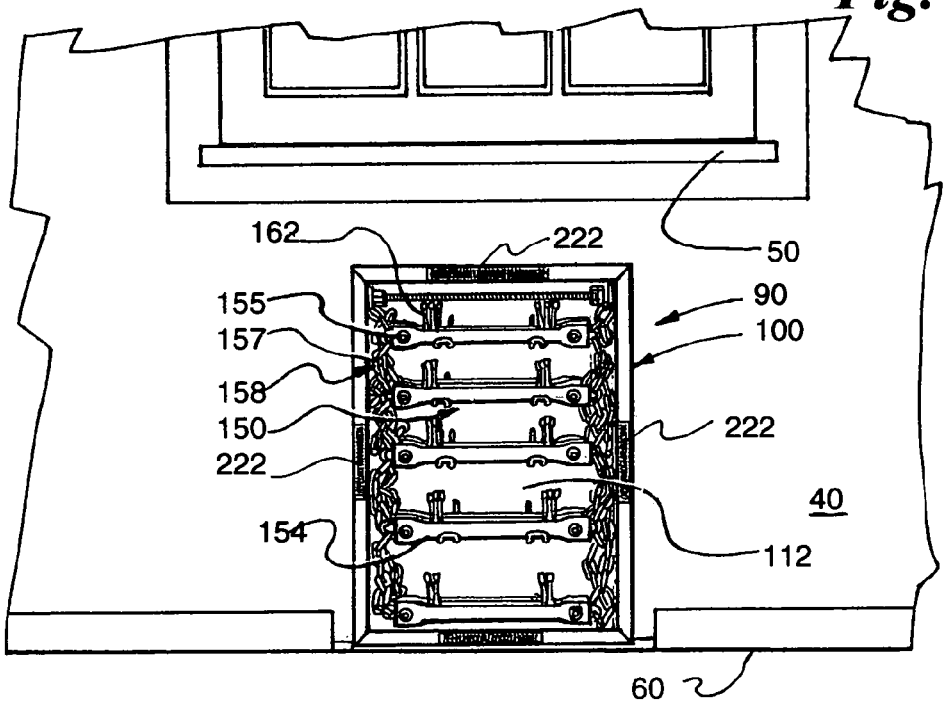
FIG. 2 is a front view of the fire escape ladder enclosure of FIG. 1 with the enclosure cover removed.
Figure 3:
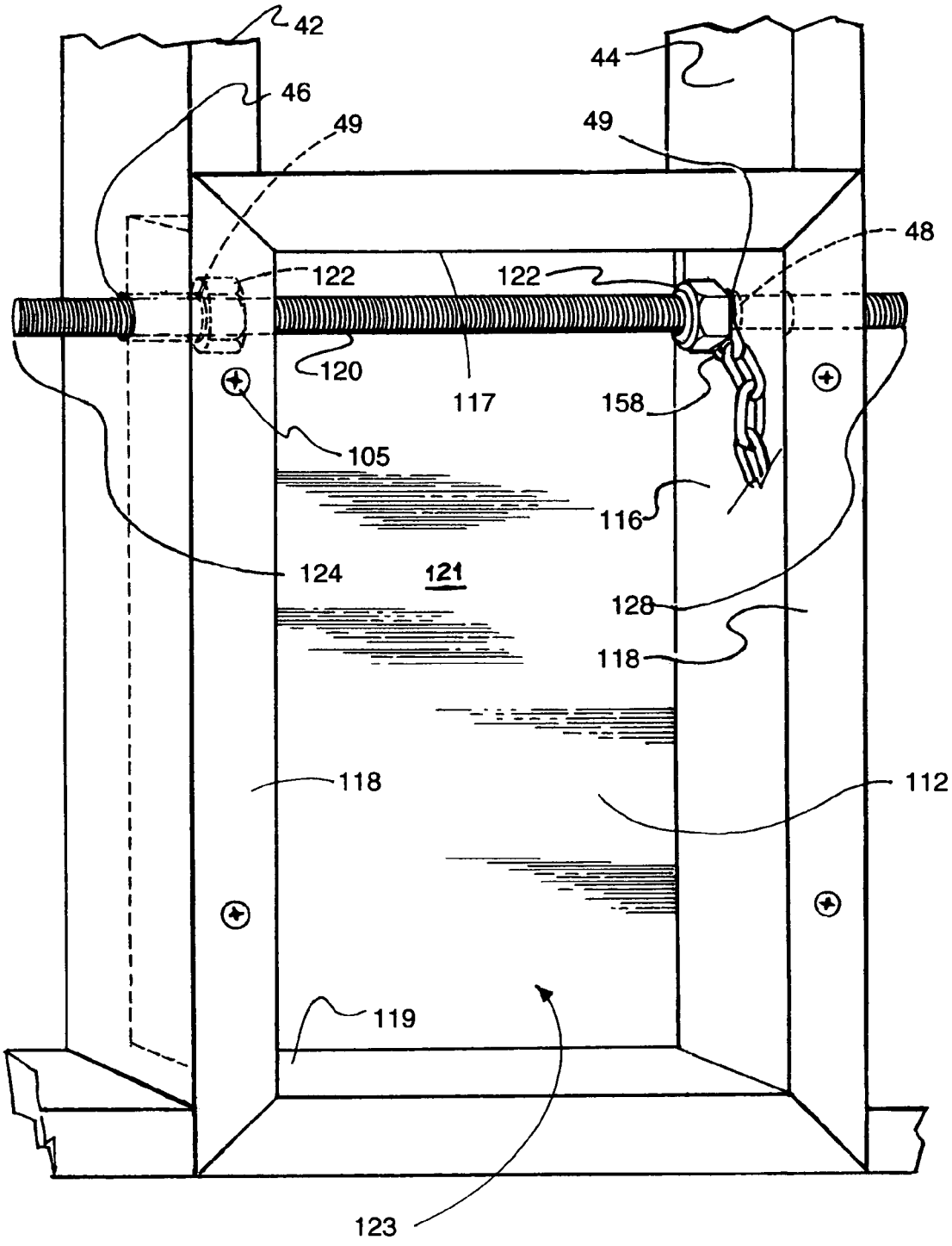
FIG. 3 is a perspective view of the fire escape ladder enclosure of FIGS. 1 and 2 in a framed building wall.

Referring to FIGS. 1–3, a fire escape ladder assembly 90 according to the invention comprises a ladder enclosure 100 adapted to be installed within a wall 40 underneath a windowsill 50. Ladder enclosure 100 desirably comprises a metal box or receptacle having sides 116 and a top 117 and a bottom 119, a closed back 121, and an open front 123. A mounting flange 118 can extend outwardly from the front edge of the box. If the box is to be completely concealed in a wall, the box may not employ a mounting flange. The box is formed by stamping or bending or other suitable manufacturing method and may be formed out of any material suitable for the purposes. Steel is desirable. A substantially flat enclosure cover 110 covers the open front of enclosure 100 and a ladder 150 within the enclosure 100 when the fire escape ladder 150 is not in use. In the embodiment shown in FIG. 1, the ladder enclosure 100 extends from the windowsill 50 to a floor 60 of the structure.

Referring to FIG. 2, the ladder 150 is stowed within the enclosure interior compartment 112. The ladder 150 comprises a number of parallel rungs 154 connected at each end by bolts 155 that engage spaced links 157 in a chain support member 158 so that each rung is evenly spaced from other rungs 154 along the length of the ladder 150. The chains 158 shown in FIG. 2 that form the longitudinal portion of the ladder could be replaced with other known fire-resistant flexible support members. Each of the rungs 154 includes a pair of stand offs 162 (see FIG. 6) for positioning the ladder 150 away from an exterior wall of the building structure when the ladder 150 is in the deployed position.

Referring to FIG. 3, the enclosure 100 forms a substantially rectangular frame that is adapted to be mounted between a pair of building structure wall studs 42, 44, substantially filling the space between the studs 42, 44. Each of the enclosure sidewalls 116 is adapted to abut one stud 42, 44. If the enclosure further includes a face frame or flange 118, the frame can abut the surface of the wall 40 and provides a finished appearance around the edges of the enclosure 100. The face frame is screwed into the building studs by screws 105 to mount the frame in place. The frame can be mounted in an existing wall, with the flange on the outer side of the wall; or the frame can be installed in new construction, with the flanges being mounted under or over the wall board, as desired. The flange can be eliminated if desired for a flush construction.

As particularly shown in FIG. 3, a rod 120 threaded at least on the ends is mounted in the enclosure 100 for the purpose of anchoring the ladder 150 while in the deployed position. The ladder is not shown in FIG. 3 for purposes of clarity. The threaded rod 120 is adapted to pass through openings 49 in the enclosure sidewalls 116 and through openings in the adjacent studs 42, 44. With the enclosure 100 in place between studs 42, 44, opposing apertures 46, 48 are drilled through the adjacent studs 42, 44. The apertures 46, 48 are aligned with apertures 49 on opposite enclosure sidewalls 116.

Figure 4:
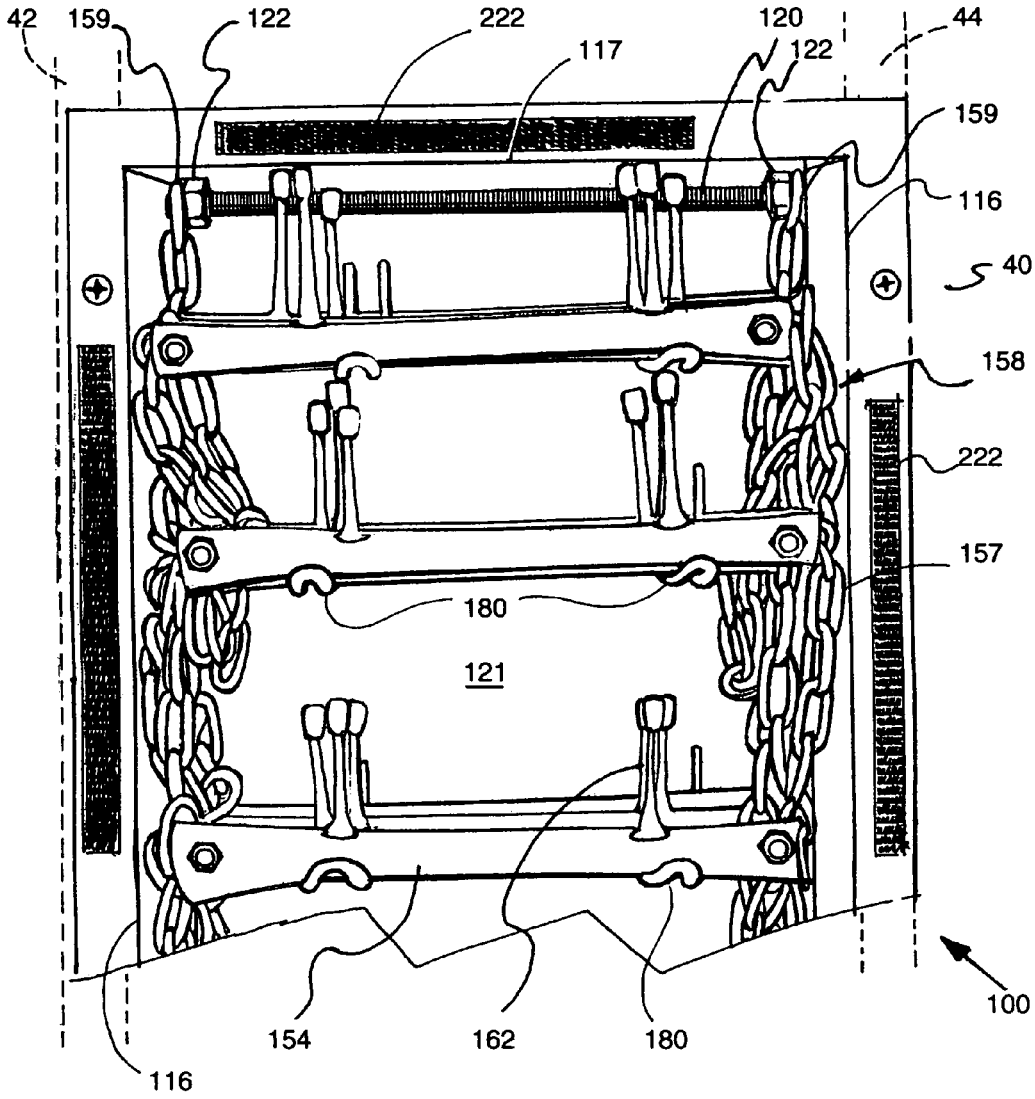
FIG. 4 is a front view of the fire escape ladder enclosure of FIGS. 1–3, with a fire escape ladder in a storage configuration.

Threaded rod 120 includes a first end 124 and a second end 128. Threaded rod 120 is of a length such that first end 124 can be passed through aperture 46 a sufficient distance so that second end 128 can be aligned with aperture 48. Second end 128 is then passed through aperture 48 so that threaded rod 120 is centered on enclosure 100, each of ends 124, 128 extending into or through studs 42, 44. Prior to threaded rod 120 being fed through apertures 46, 48, a pair of lock nuts 122 are threaded onto threaded rod 120, and upper end links 159 of ladder chains 158 are slid onto threaded rod 120. With threaded rod 120 centered in enclosure 100, lock nuts 122 are rotated to move outwardly on threaded rod 120 until they are flush against links 159 against enclosure sidewalls 116. This prevents threaded rod 120 from sliding to one side or the other and keeps threaded rod 120 within apertures 46, 48. (see FIG. 4). This further secures links 159 and anchors ladder 150 on threaded rod 120. Hooks 180 (which can be conventional peg board hooks) are mounted on the back 121 of the enclosure and engage the ladder rungs and support the ladder in a folded condition in the enclosure. Peg board type hooks are desirable because they fall off when the ladder is deployed, thus preventing the hooks from obstructing the deployment of the ladder.

Figure 5:
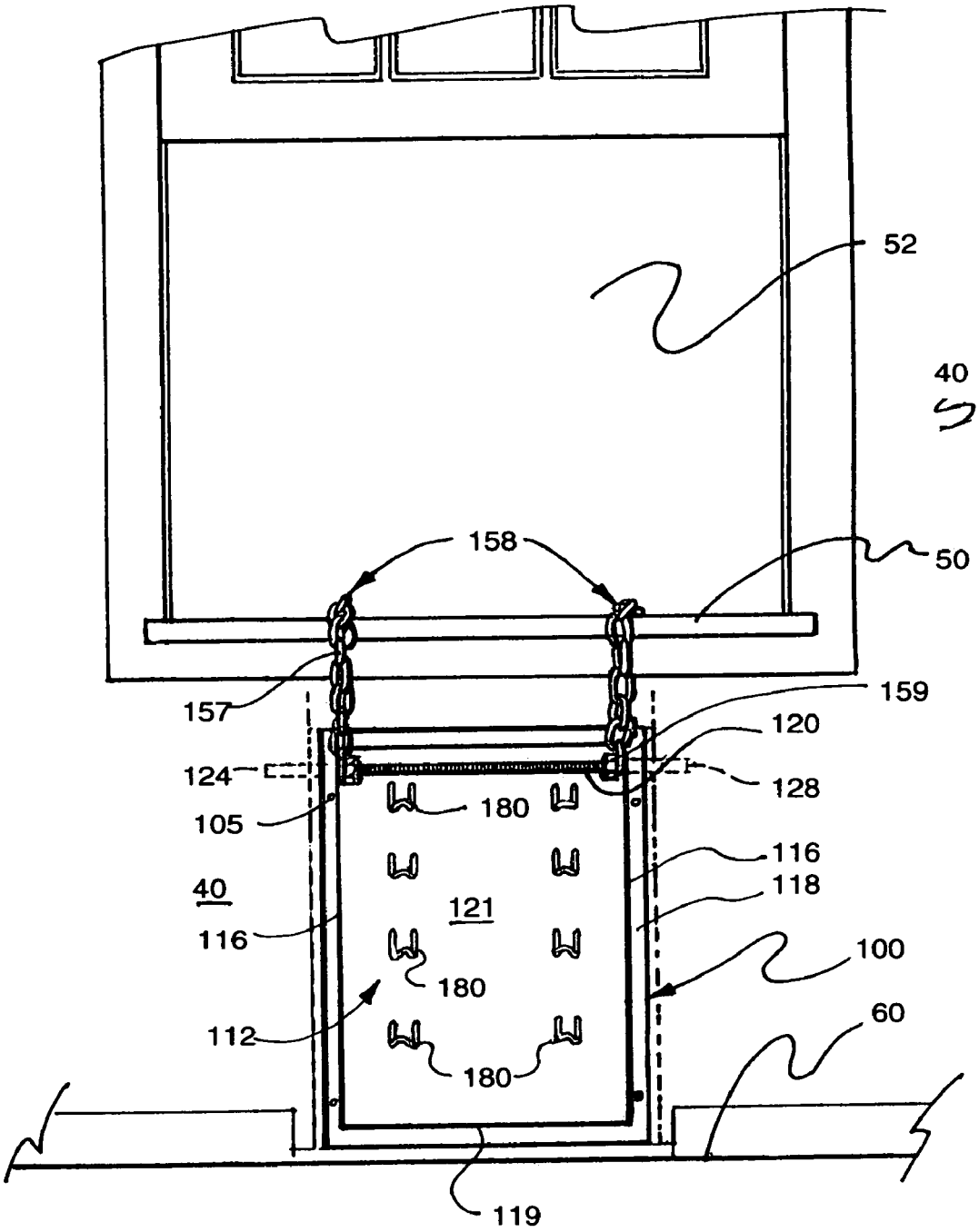
FIG. 5 is a front view of a fire escape ladder enclosure of FIGS. 1–4 installed underneath a building window.
Figure 6:
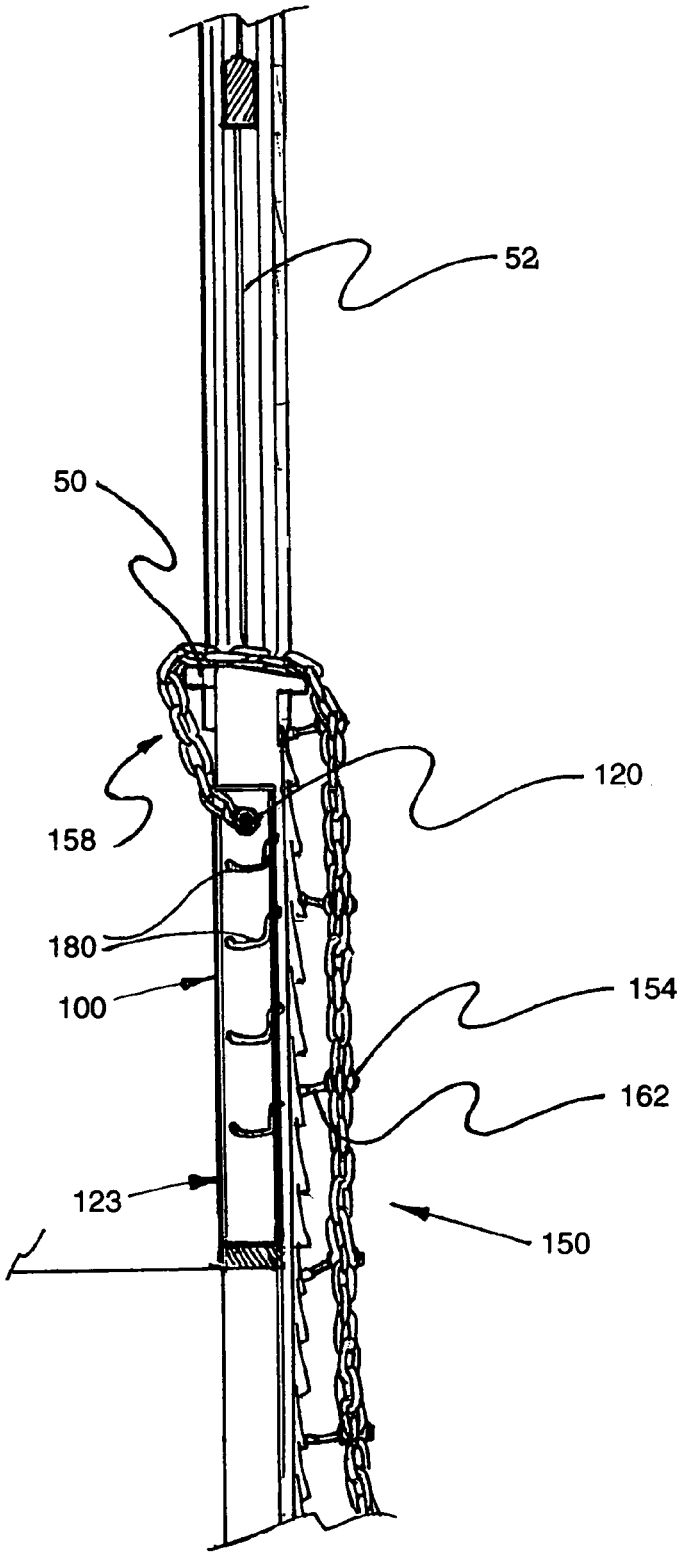
FIG. 6 is a cross sectional view of the fire escape ladder enclosure of FIGS. 1–5 in a use configuration.

Referring to FIGS. 5 and 6, ladder 150 is deployed by removing the ladder 150 from within enclosure 100 and passing it through window opening 52 with an end of ladder 150 secured to threaded rod 120 within enclosure 100. Ladder 150 falls under gravity to be substantially parallel with the exterior wall of the structure. Ladder 150 is held a distance from the exterior wall by standoffs 162, which are arranged to abut against the exterior wall. The standoffs 162 can be mounted on each rung 154 or can be mounted on every other rung 154, or other spacing.

Figure 7:
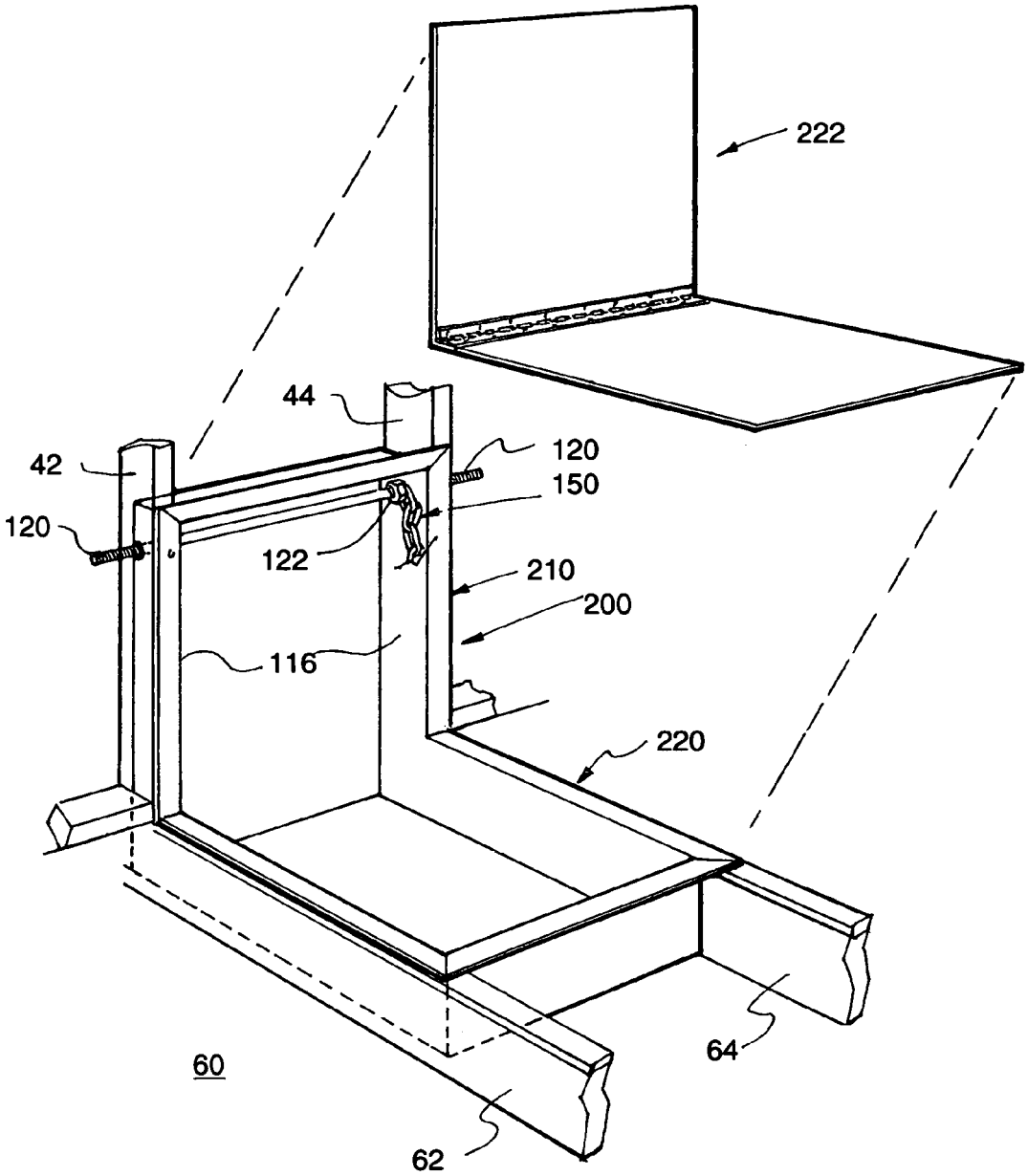
FIG. 7 is a perspective view of a further embodiment of a fire escape ladder enclosure according to the invention.

A further embodiment of a ladder enclosure 200 is shown in FIG. 7. In some building structures, a windowsill 50 is positioned at a height close to floor 60, affording insufficient space for a ladder enclosure 100 according to the first embodiment. In such an instance, there is a need for a ladder enclosure 200 which affords sufficient room for storage of the ladder 150 (not shown).

The enclosure 200 incorporates a wall portion 210 and a floor portion 220. The wall portion 210 is positioned between adjacent wall studs 42, 44 while the floor portion 220 is positioned between adjacent floor joists 62, 64. A threaded rod 120 is inserted through apertures in the sidewalls 116 of the wall portion 210 and locked in place with lock nuts 122 in a similar fashion as to the first embodiment. The ladder 150 (not shown) is attached to the threaded rod 120 in a similar fashion to the other embodiment, with the ladder 150 being stowed in both the wall section 210 and the floor portion 220 of enclosure 200. An L-shaped or hinged enclosure cover 222 covers the enclosure 200 when the ladder 150 is not in use. The ladder 150 is deployed in the same manner as in the first embodiment. The total length of enclosure 200, including wall and floor sections, is the same as the wall unit described above, which is about twenty-four inches in a typical installation. The doors in both embodiments can be releasibly attached by a Velcro type hook and loop fastener 222 or other suitable and easily releasable fastener.

Figure 8:
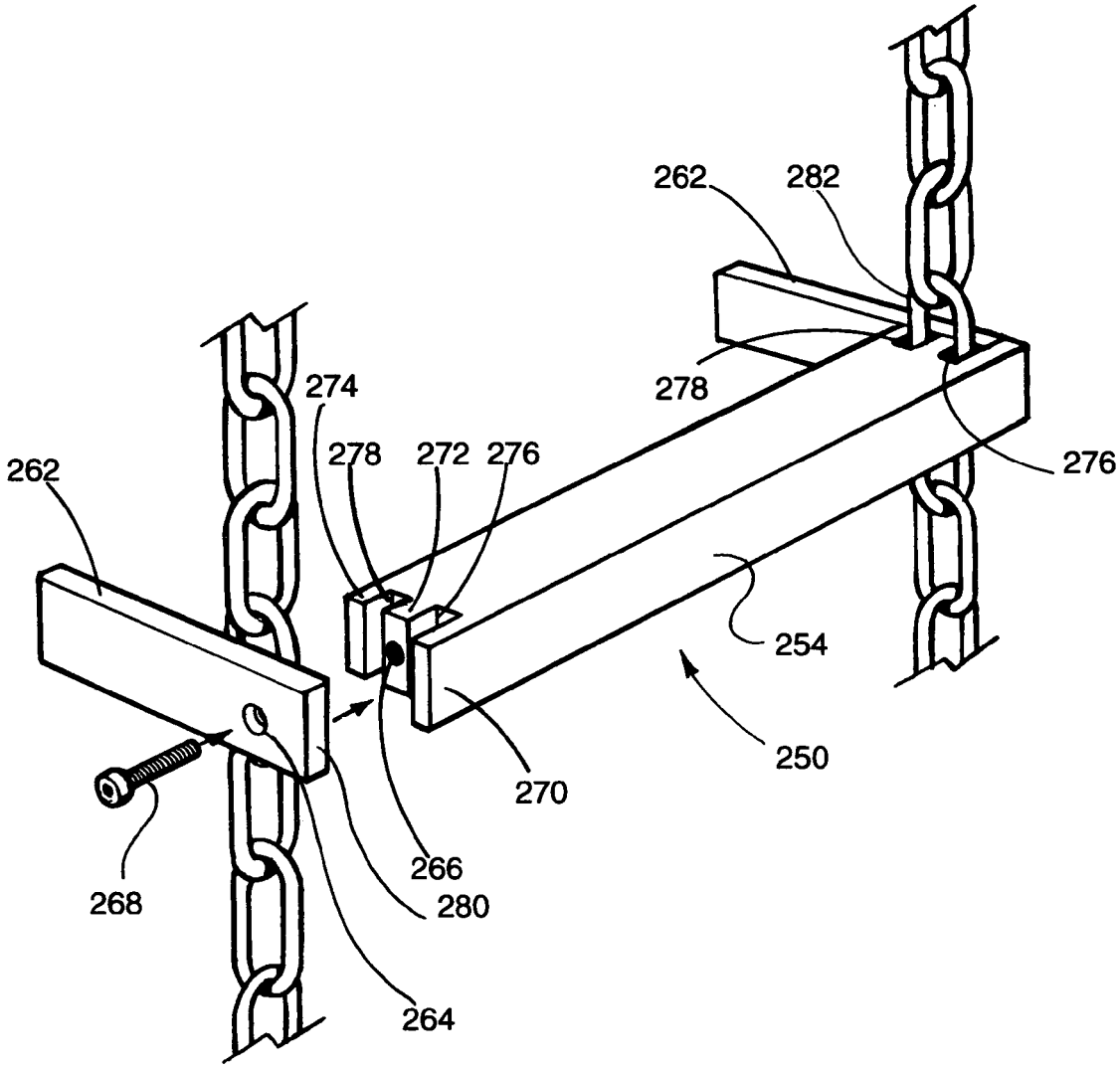
FIG. 8 is a partially exploded perspective view of another embodiment of a rung and standoff mechanism.

Another embodiment 250 of a rung and standoff assembly is shown in FIG. 8. While rungs 154 are formed of tubes with flattened ends that are bolted to the links, rung 254 of assembly 250 comprises an elongated bar or channel member formed of aluminum or the like. Standoffs 262 also are aluminum bars or channel members positioned at each end of the rung 254. Openings 264 in the ends of the standoffs mate with threaded openings 266 in the ends of rung 254, and threaded fasteners 268 extend through openings 264 and into openings 266 to securely attach the standoffs 262 to the ends of rung 254.

The end of rung 254 includes three outwardly extending ribs 270, 272, and 274, with recesses 276 and 278 being positioned between the ribs. Rib 270 extends outwardly further than ribs 272 and 274 and abuts the end 280 of standoff 262 when the standoff is mounted to the rung. When the standoff is mounted to the rung, recesses 276 and 278 form downwardly extending spaced openings through the ends of the rung and standoff assembly. A link 282 of the chain fits in recesses 276 and 278 so that the chain can be firmly clamped to the step mechanism by inserting a link in the chain in the recesses in the end of the step and then screwing the standoff in place on the end of the step.

While steps and standoffs formed of an aluminum bar material are satisfactory, the use of other shapes, such as U-shaped channels, and other types of formed components, such as extruded, tubular, or stamped components, would be satisfactory and would involve less material and less labour and would provide a less expensive product.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

What is claimed is:

1. A fire escape ladder assembly comprising:

an enclosure that is mountable in the wall of a building below a sill of an access window in the building, the enclosure having an open interior positioned between spaced sidewalls, the sidewalls being spaced apart such that the enclosure is adapted to fit between spaced vertical wall support members of the building structure, the enclosure further comprising a front that is openable to provide access to the open interior of the enclosure;

a lateral support rod that is wider than the enclosure, the rod extending through the interior of the enclosure and protruding outwardly through openings in outer sides of the sidewalls of the enclosure, the support rod being long enough that it will extend through openings in the wall support members on opposite sides of the openings in the enclosure sidewalls;

a folding ladder mounted at an upper end thereof to the support rod, the ladder being collapsible so as to fit in the open interior of the enclosure when not in use, the ladder being removable from the enclosure so it can extend through the access window and hang downwardly on the outside of the building for emergency exit from the building, the ladder being adapted to be securely supported by the building support members by the lateral support rod; and a releasable lock that holds the support rod in a predetermined axial position in the enclosure, wherein the rod is held in supporting engagement with building supports at both ends of the rod when mounted in the wall of a building.

2. A fire escape ladder assembly as in claim 1 wherein the ladder comprises lateral rungs spaced longitudinally on a pair of spaced chain support members, the rungs being suspended on hooks in the interior of the enclosure when the ladder is stored in the open interior of the enclosure.

3. A fire escape ladder assembly as in claim 2 wherein the cover panel is attached to the enclosure by a hook and loop fastener.

4. A fire escape ladder assembly as in claim 1 wherein the front of the enclosure is covered by a cover panel that is releasibly mounted on the enclosure.

5. A fire escape ladder assembly comprising:

an enclosure that is mountable in the wall of a building below a sill of an access window in the building, the enclosure having an open interior positioned between spaced sidewalls, the sidewalls being spaced apart such that the enclosure is adapted to fit between spaced vertical wall support members of the building structure, the enclosure further comprising a front that is openable to provide access to the open interior of the enclosure;

a lateral support rod that is wider than the enclosure, the rod extending through the interior of the enclosure and protruding outwardly through openings in outer sides of the sidewalls of the enclosure, the support rod being long enough that it will extend through openings in the wall support members on opposite sides of the openings in the enclosure sidewalls and also being axially movable in the openings such that the support rod can be inserted in the building wall support members by first extending the rod through one the openings in side of the enclosure and structural member and then extending the rod through the openings on the other side of the enclosure and structural member so that the rod is positioned in the openings on both sides of the enclosure, said movement occurring at least in part with the enclosure in place in the building wall;

a folding ladder mounted at an upper end thereof to the support rod, the ladder being collapsible so as to fit in the open interior of the enclosure when not in use, the ladder being removable from the enclosure so it can extend through the access window and hang downwardly on the outside of the building for emergency exit from the building, the ladder being adapted to be securely supported by the building support members by the lateral support rod; and a releasable lock that holds the support rod in a predetermined axial position in the enclosure, wherein the rod is held in supporting engagement with building supports at both ends of the rod when mounted in the wall of a building.

6. A fire escape ladder assembly as in claim 3 wherein the lock is axially movable from a first position, wherein the rod can be inserted into both building supports when the assembly is mounted in the wall, to a second position wherein the rod is locked in position in the enclosure, with the rod positioned in engagement with both building supports when the assembly is mounted in the wall.

7. A fire escape ladder assembly as in claim 5 wherein the lock includes a pair of threaded nuts mounted on threaded portions of the support rod.

8. A fire escape ladder assembly comprising:

an enclosure that is mountable in the wall of a building below a sill of an access window in the building, the enclosure having an open interior positioned between spaced sidewalls, the sidewalls being spaced apart such that the enclosure is adapted to fit between spaced vertical wall support members of the building structure, the enclosure further comprising a front that is openable to provide access to the open interior of the enclosure, further being L-shaped and further having a lower portion that is adapted to fit between floor joists in a building enclosure, the L-shaped enclosure providing increased ladder storage capacity for a building structure with window sills that are too close to the floor to provide adequate ladder storage capacity in the building wall;

a lateral support rod that is wider than the enclosure, the rod extending through the interior of the enclosure and protruding outwardly through openings in outer sides of the sidewalls of the enclosure, the support rod being long enough that it will extend through openings in the wall support members on opposite sides of the openings in the enclosure sidewalls;

a folding ladder mounted at an upper end thereof to the support rod, the ladder being collapsible so as to fit in the open interior of the enclosure when not in use, the ladder being removable from the enclosure so it can extend through the access window and hang downwardly on the outside of the building for emergency exit from the building, the ladder being adapted to be securely supported by the building support members by the lateral support rod.

9. A fire escape ladder assembly for insertion between spaced building frame studs in an interior opening in a building wall below a window opening, the ladder assembly comprising:

an enclosure that is adapted to fit between the spaced studs, the enclosure having sides that are spaced to be positioned adjacent each of the spaced studs, the enclosure being provided with opposed side openings that are adapted to align with opposed openings provided in the spaced studs;

the enclosure having an open interior and an openable front access to the open interior;

a support rod that fits through the enclosure openings and stud openings when installed in a building and is long enough to extend through the enclosure and both stud openings simultaneously for supporting engagement in the openings in the opposed studs when installed, the support rod being axially movable in the enclosure for mounting the enclosure and rod in the wall;

axial securing means for securing the axial position of the support rod in the studs, such that the ends of the rod remain in mating engagement in the openings in the studs; and a collapsible ladder supportingly mounted at an upper end to the support rod, the ladder being collapsible into the open interior of the enclosure.

10. A fire escape ladder assembly according to claim 9 wherein the support rod is at least partially threaded and the axial securing means comprise threaded nuts that thread on the support rod and are axially movable on the support rod to a position adjacent the studs, so as to restrain the support rod from axial movement out of engagement with the studs.

11. A fire escape ladder assembly as in claim 9 wherein the openable front of the enclosure is covered by a removable door.

12. A fire escape ladder assembly as in claim 9 wherein the enclosure is L-shaped, with a vertical portion adapted to fit in the building wall and a horizontal portion adapted to fit in a floor of a building, the L-shaped enclosure providing room in the interior of the enclosure in situations where the window sill is too low to provide enough room for the ladder in the wall alone.

13. A fire escape ladder assembly as in claim 9 wherein the ladder includes a pair of elongated, flexible vertical supports having spaced rungs extending therebetween and with standoffs being spaced along the supports.

14. A fire escape ladder assembly as in claim 13 wherein the vertical supports comprise linked chain.

15. In a building having a building opening between spaced vertical wall studs positioned below a window opening, the improvement comprising a fire escape ladder assembly including:

an elongated support rod that is longer than the spacing between the studs, such that the rod is adapted to slidingly fit through opposed openings in the studs and is thereby supportable by the studs;

a releasable lock that is adapted to hold the support rod in a predetermined axial position in the stud opening, the rod thereby being adapted to be held in supporting engagement with the studs at both ends of the rod;

a foldable ladder comprising a collapsible elongated support member with foot supports spaced therealong, the support member being attached to the support rod at an inner end of the support member, the ladder being collapsible and stowable in the building opening when not in use.

16. A method for installing a collapsible fire escape ladder in a wall opening between spaced building frame studs comprising:

forming opposed openings in the spaced studs;

mounting a support rod in the building frame by inserting one end of the rod through one stud opening and then inserting an opposite end of the rod through the opening in the other stud, the rod being long enough that the ends of the rod can extend through both studs at the same time;

mounting a supported end of a collapsible fire escape ladder on the support rod before or after mounting the support rod in the building;

providing a releasable lock that holds the support rod in a predetermined axial position relative to the studs so as to prevent either end of the support rod from axial movement away from supporting engagement in the openings in the studs and the rod is held in supporting engagement with the studs at both ends of the rod;

stowing the ladder in collapsed form in the wall openings and covering the wall openings with a removable cover.

* * * * *